US005533312A

United States Patent [19]

Mihalcheon

[11] Patent Number: 5,533,312

[45] Date of Patent: Jul. 9, 1996

[54] COMPOSITE PANEL HAVING INTERLOCKED SKINS AND A BONDED FOAM CORE

[75] Inventor: Arthur A. Mihalcheon, Edmonton, Canada

[73] Assignee: Steel-Craft Door Products Ltd., Alberta, Canada

[21] Appl. No.: 346,894

[22] Filed: Nov. 30, 1994

[51] Int. Cl.[6] ..... E04C 2/292

[52] U.S. Cl. ..... 52/309.9; 52/396.04; 52/586.2; 52/590.1; 52/800.1; 52/802.1

[58] Field of Search ..... 52/805, 309.9, 52/309.11, 396.04, 590.1, 802, 586.2, 800.1, 802.1

[56] References Cited

U.S. PATENT DOCUMENTS 4,123,885 11/1978 Scott ..... 52/802 X
4,183,393 1/1980 Bailey ..... 52/309.11 X
4,441,301 4/1984 Benson ..... 52/804
4,589,240 5/1986 Kendall et al. .

*Primary Examiner*—Carl D. Friedman
*Assistant Examiner*—Christopher Todd Kent
*Attorney, Agent, or Firm*—Sheridan Ross & McIntosh

[57] ABSTRACT

A unitary, insulated panel is provided for use in sectional doors and walls. The panel comprises opposed, spaced apart, parallel, inner and outer metal skins. The skins are mechanically interlocked along their top and bottom ends by integral, inwardly projecting flanges having mutually engaged, hook-shaped terminal portions. The opposed flanges at each end are coplanar. The engaged hook-shaped terminal portions combine to form a longitudinally extending slot. The mouth of the slot is narrow relative to its bulbous inner portion. A strip of weather seal can be inserted longitudinally into the slot, for sealing purposes. Foamed polyurethane is formed in situ in the space between the skins. The polyurethane bonds to the skins. A rigid, strong panel unit is obtained by the combination of mechanically interlocking the skins and bonding them with the core.

3 Claims, 3 Drawing Sheets

COMPOSITE PANEL HAVING INTERLOCKED SKINS AND A BONDED FOAM CORE

FIELD OF THE INVENTION

The present invention relates to a unitary insulated panel for use in sectional doors and curtain walls. The panel comprises spaced apart inner and outer metal skins bonded to an internal core of plastic foam and mechanically interlocked by hook means at their top and bottom ends.

BACKGROUND OF THE INVENTION

Insulated panels are commonly used in sectional garage doors, curtain walls and the like.

Commonly, such panels utilize parallel, opposed, spaced-apart steel skins separated by a core of plastic foam. The foam is formed in situ and is bonded with the skins. The top and bottom marginal portions of the skins are bent inwardly to form perpendicular flanges. These flanges usually have an L configuration, so that the inner leg of the L extends parallel to the main plane of the skins. This parallel leg is buried in the foam core. The buried legs of the two flanges associated at one end of the panel are positioned in spaced apart relationship, to create a thermal break. Thus heat or cold affecting the exposed metal outer skin does not have a conductive connection with the inner skin.

A problem associated with such prior art panels is that the integrity of the panel depends on the adhesion between the metal skin and the plastic core. The panels can fall apart when the skin and core begin to separate in use.

U.S. Pat. No. 4,589,240, issued to Kendall et al., discloses a panel in which the associated flanges at top and bottom are formed to provide hook-shaped terminal portions. These hook means are engaged to mechanically interlock the skins. A thermal break is provided at each joint formed by the hook means. More particularly, an elongate vinyl element having a double C configuration is provided to fit like a sock over one of the hook means. The vinyl element includes a bead at an outer end spaced from the hook means, for serving as a weather seal. The core is pre-formed, rather than being foamed in-situ. This is done in part so that the skins can be pressed together to bring the hooks into engagement while compressing the core. The core then expands, when pressure is released, to "set" the hooks.

SUMMARY OF THE INVENTION

The present invention involves forming a panel so as to interconnect the skins both by a mechanical interlock using hook means and by bonding to a plastic core that has been foamed in situ.

The hook means are preferably formed so as to create an elongated, open-mouthed slot extending longitudinally of the top and bottom edges of the panel. The mouth of each slot is narrow relative to its inner portion, which is bulbous in configuration. An elongated strip of weather seal can be provided to seat in and be held by the walls of the slot, said strip protruding from the slot to seal against the abutting surface of the next panel.

In another preferred feature, the skins are roll formed so that the hooks of the hook means are overlapping and engaged but they remain out of physical contact. Thus a thin air gap exists between each associated pair of hook means to provide a thermal break. If the plastic bond begins to fail and the skins move apart, the hook means are brought into contact and prevent further separation of the skins.

In another preferred feature, the flanges are each comprised of a leg portion and a hook means at the terminal end of the leg portion. The leg portions of opposed flanges are arranged to be substantially coplanar when assembled.

The main advantage of the invention is that a panel is provided having a high degree of cohesion and structural strength.

DESCRIPTION OF THE PREFERRED EMBODIMENT

Figure 1A:
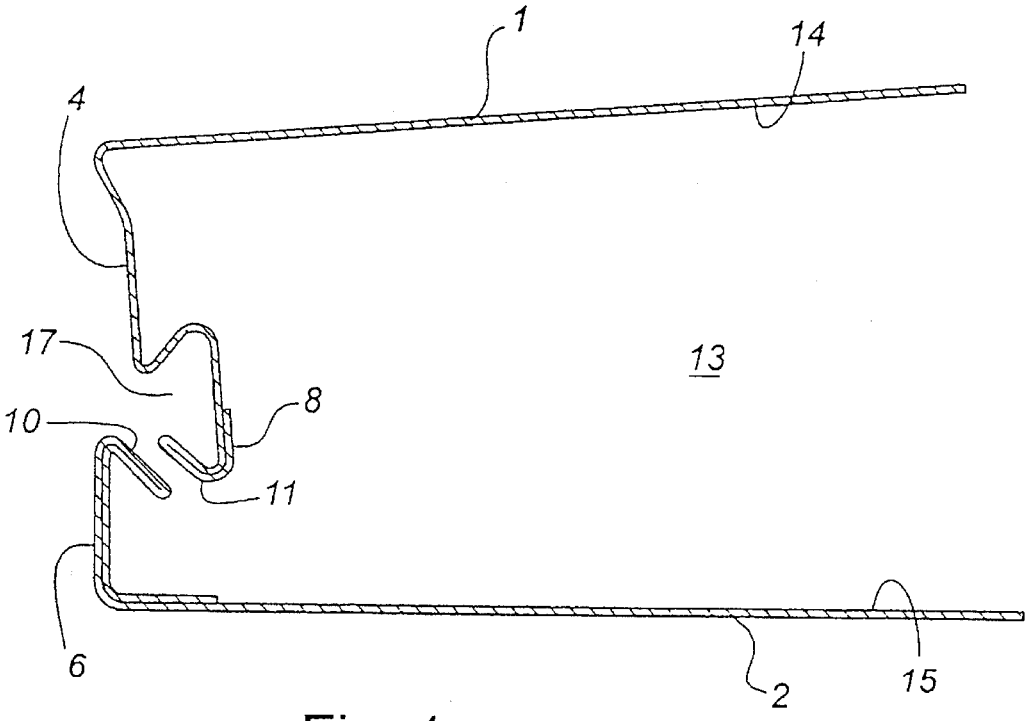
FIG. 1*a* is an end view showing the flanges on one side of the panel skins in the course of engaging the hook means.

During fabrication, a pair of horizontal, parallel, opposed, spaced apart, thin steel strips or top and bottom "skins" 1,2 are fed longitudinally through a roll-forming assembly (not shown). These top and bottom skins become "inner" and "outer" skins when the finished panel is positioned on edge in use. The panel will be described as if it is horizontal.

The marginal side portions of each skin 1,2 are bent inwardly, partly doubled back and formed to produce generally perpendicular flanges 3,4 and 5,6 having elongated hook means 7,8 and 9, 10 extending along their inner edges. The pair of flanges on each skin have hook means opening in opposite directions. Thus each pair of opposed top and bottom hook means on one side of the two skins are oppositely directed.

Each hook means 7,8 of the top skin 1 is formed in the shape of a flat and wide bottomed U, to provide a bulbous, narrow mouthed channel or slot 17, having a hook member 11 at its inner end.

The opposed pairs of hook means 7,9 and 8, 10 are adapted, when engaged, to overlap and mechanically interlock to hold the skins 1,2 together along their side edges.

When the top and bottom hook means 7,8 and 9, 10 are engaged, a narrow gap 12 is preferably left between their engaged portions. These air gaps 12 function as thermal breaks between the skins 1,2.

Figure 1B:
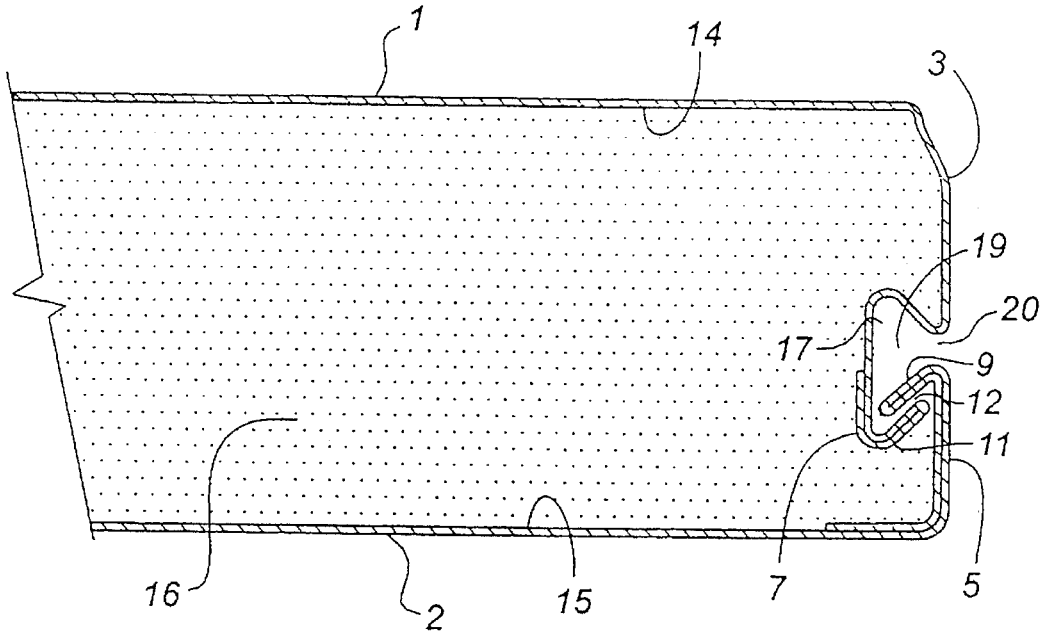
FIG. 1*b* is an end view showing the other side of the panel, with the hook means engaged and the space between the skins filled with plastic foam, which is adhesively bonded to the skins.
Figure 2:
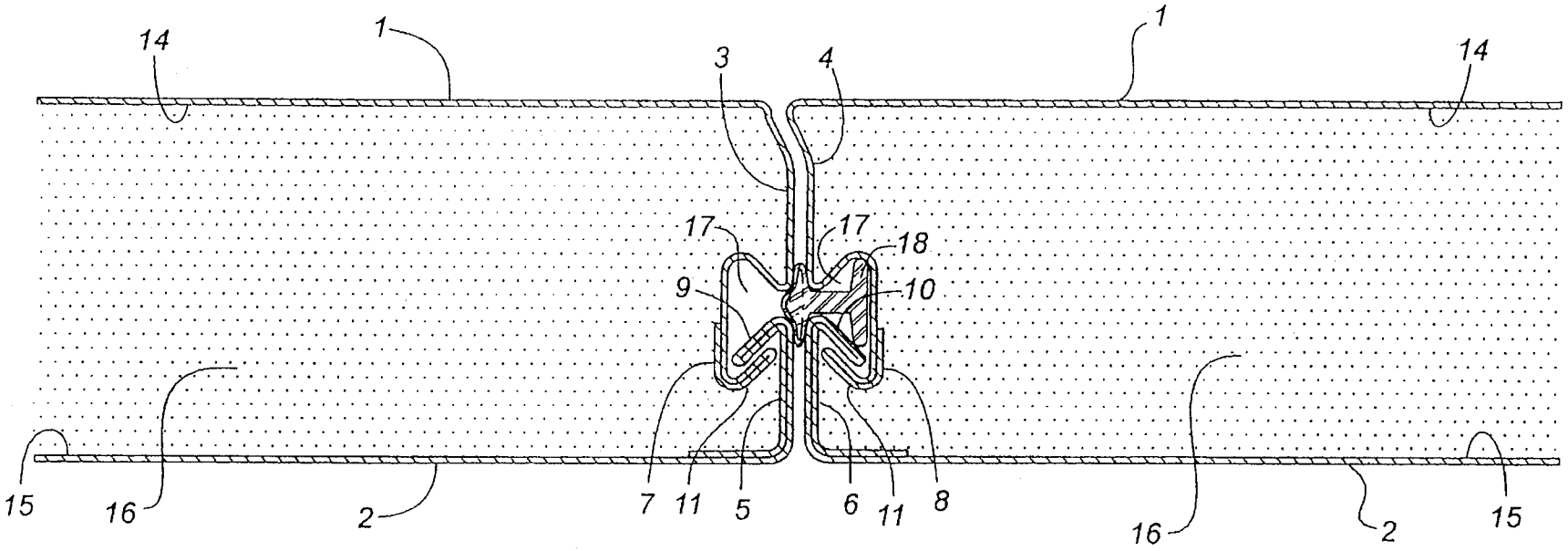
FIG. 2 is an end view showing the top and bottom portions of two abutting panels, with a foamed plastic weather seal, formed in situ, in place in one slot.
Figure 3:
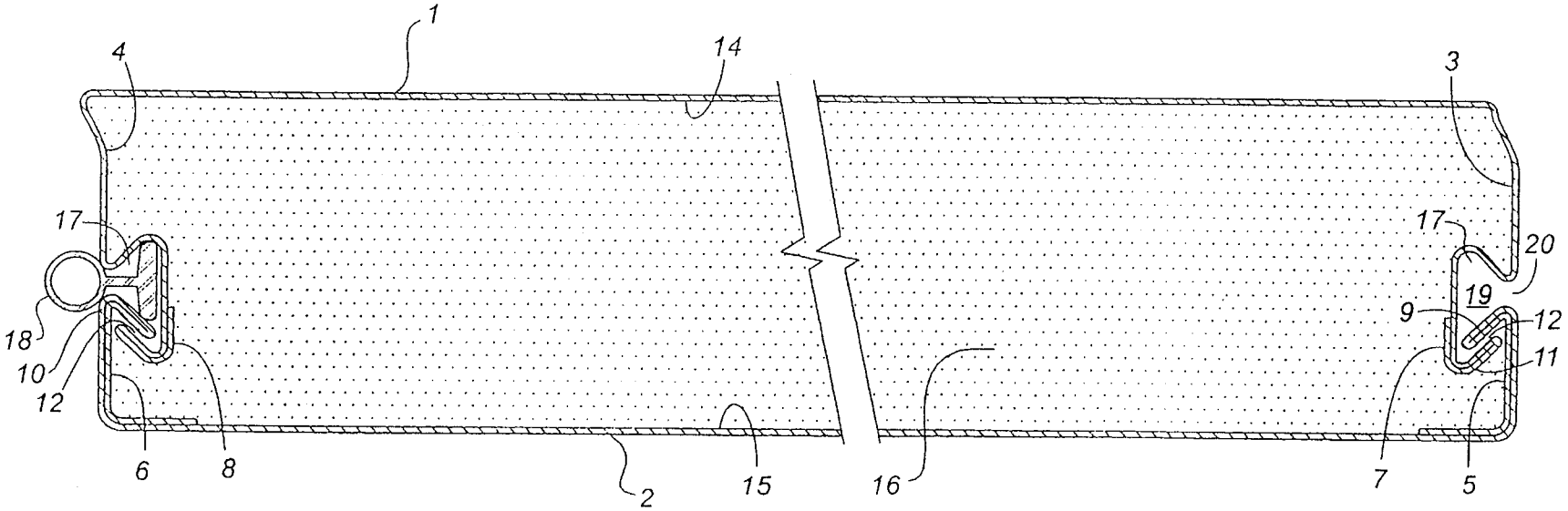
FIG. 3 is an end view of a complete panel showing a rubber weather seal at one end.

Engagement of each opposed pair of hook means 7,9 and 8,10 is achieved by bowing the top flange sideways (see FIG. 1*a*), with the skins 1,2 spaced relatively far apart, and then bringing the skins closer together and releasing the bowed flange so that it springs back toward the bottom flange and the top and bottom hook means engage. See FIG. 1*b*.

Before the skins are roll-formed, the ingredients for generating polyurethane foam are centrally deposited on the inner surface 15 of the bottom skin 2. After roll-forming and engagement of the hook means, the strips 1,2 form a space 13 between them, closed along its sides by the engaged flanges. Upon curing with heat, the ingredients foam and produce a core 16. This foam core fills the space 13 and contacts and bonds to the inner faces 14, 15 of the skins 1,2.

The resulting product at the end of fabrication is a unitary insulated panel of generally rectangular form. It comprises flanges having hook means engaged along each of its sides, to provide side closure and a mechanical interlock for holding the skins together. The interior space of the panel is filled with a foam core which is bonded to the skins. Each pair of opposed flanges combine to form a slot, having a narrow mouth and bulbous space 19, extending along each side edge of the panel.

A strip 18 of rubber weather stripping may be threaded into a slot 17, to protrude therefrom and seal against an abutting panel. Alternatively, a bead 18*a* of plastic can be deposited in the slot and foamed in situ to fill the bulbous space 19 and protrude through the mouth 20 of the slot 17.

What is claimed is:

1. A unitary insulated panel having top and bottom sides and being of rectangular form, comprising:

inner and outer metal skins arranged in opposed and spaced apart relationship so that a space is formed between them, each skin having an inner face and top and bottom inwardly projecting flanges, the top flanges being opposed and forming the top side of the panel, the bottom flanges also being opposed and forming the bottom side of the panel;

each opposed pair of flanges forming oppositely directed hook means which overlap and engage to mechanically interlock the skins;

each pair of overlapping and engaged hook means combining to form a slot, extending longitudinally of the side of the panel, said slot having a relatively narrow mouth and a bulbous inner section so that an elongate strip of weather seal can be retained in the slot and protrude through the mouth thereof to seal against an abutting panel; and a foam core, having been formed in situ within the space between the skins, said core filling the space and being bonded to the inner faces of the skins.

2. The panel as set forth in claim 1 wherein each flange comprises a leg portion and the hook means, the leg portions of opposed flanges being generally coplanar.

3. The panel as set forth in claim 1 or 2 wherein the engaged hook means are spaced apart to form a thermal break of insulating air therebetween.

* * * * *